United States Patent [19]

Pic

[11] 4,033,590

[45] July 5, 1977

[54] APPARATUS FOR DISTRIBUTING PLAYING CARDS AUTOMATICALLY

[76] Inventor: Francoise Pic, Allee Beau-Rivage l-Alba, Bergerac (Dordogne), France

[22] Filed: Jan. 22, 1976

[21] Appl. No.: 651,231

Related U.S. Application Data

[63] Continuation-in-part of Ser. No. 500,299, Aug. 26, 1974, abandoned.

[52] U.S. Cl. ..... 273/149 R

[51] Int. Cl.[2] ..... A63F 1/14

[58] Field of Search ..... 273/149 R; 271/130, 271/131, 136

[56] References Cited

UNITED STATES PATENTS

| | | | |
|---|---|---|---|
| 999,670 | 8/1911 | Murch | 273/149 R |
| 1,824,542 | 9/1931 | Hangerud | 273/149 R |
| 1,831,580 | 11/1931 | Stecker | 273/149 R |
| 1,850,114 | 3/1932 | McCaddin | 273/149 R |

FOREIGN PATENTS OR APPLICATIONS

| | | | |
|---|---|---|---|
| 291,230 | 4/1916 | Germany | 273/149 R |
| 370,689 | 4/1932 | United Kingdom | 273/149 R |
| 23,336 | 11/1908 | United Kingdom | 273/149 R |

*Primary Examiner*—AntonO. Oechsle
*Attorney, Agent, or Firm*—Wolf, Greenfield & Sacks

[57] ABSTRACT

An automatic machine for distributing playing cards or the like includes a rotatable table on which a deck of cards is supported. The rotatable table includes a reciprocating card ejection mechanism which operates during and in response to rotation of the table and which ejects cards at a plurality of locations about the device. One or more cards can be distributed at each surrounding location as desired. The device is electrically powered and includes means to automatically stop its rotation after the last card in the deck has been distributed.

19 Claims, 23 Drawing Figures

FIG. 1
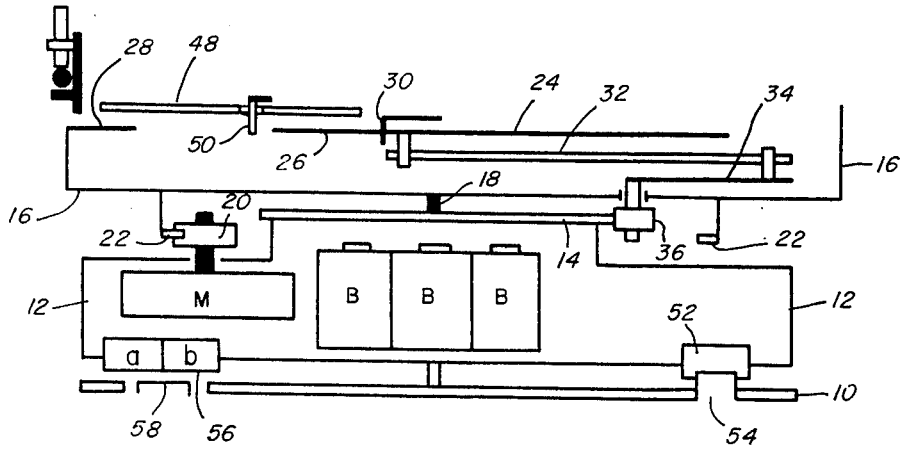
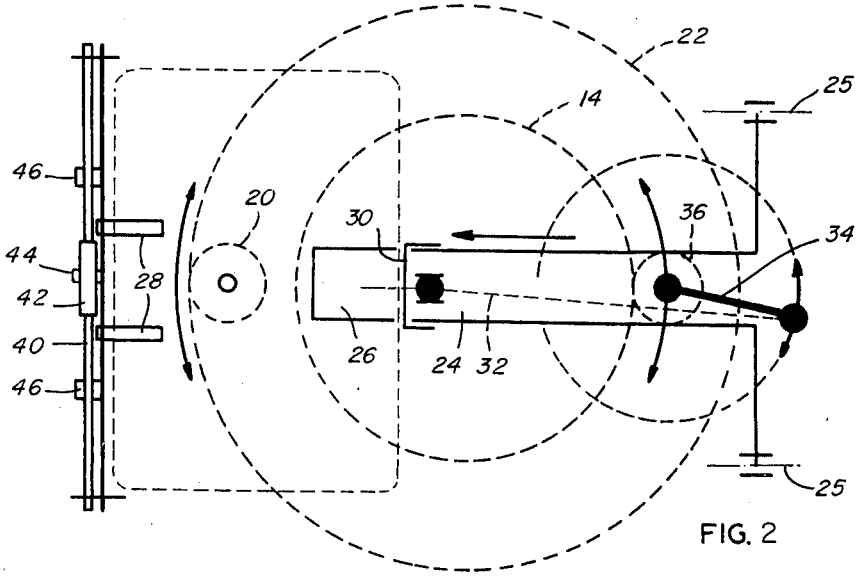
FIG. 2
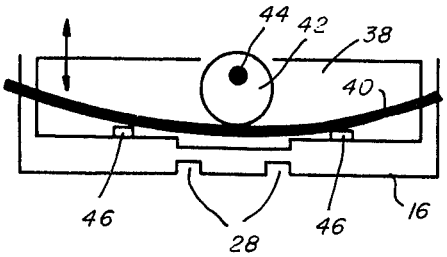
FIG. 3

Fig. 15
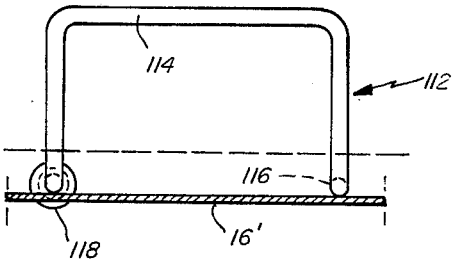
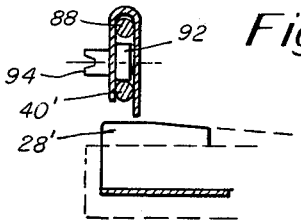
Fig. 16
Fig. 17
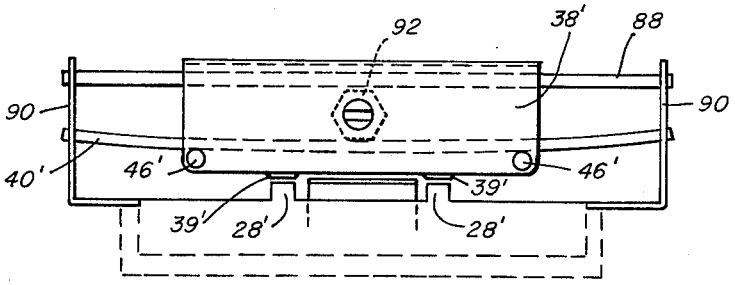
Fig. 18
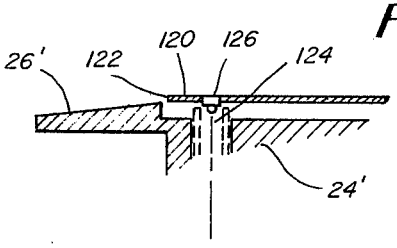

APPARATUS FOR DISTRIBUTING PLAYING CARDS AUTOMATICALLY

RELATED APPLICATION

This application is a continuation-in-part of my prior copending application Ser. No. 500,299 filed Aug. 26, 1974, and now abandoned.

BACKGROUND OF THE INVENTION

This invention relates to a device for distributing playing cards or the like in equal number and to each of a plurality of locations circumferentially spaced about the device. While playing card distributing devices have been proposed previously, they generally present a number of difficulties and problems. Typically, the prior card distributing devices are manually operated in that they must be started, operated and stopped by hand. In general, they employ a mode of operation in which a card is selected and pushed away partly from the deck, the card then being engaged and ejected by a separate spring-type of device. Such devices generally are mechanically complicated, are noisy and work relatively slowly. In addition, they often do not operate properly when the cards have been used or slightly worn and, not infrequently, the devices themselves tend to deteriorate rapidly the condition of the cards which exaggerates the inherent difficulties. Also among the difficulties with the prior devices is that they do not eject the cards equal distances from the device. It is among the primary objects of the invention to provide an improved playing card ejection device which avoids the foregoing and other difficulties.

SUMMARY OF THE INVENTION

The device includes a fixed base, a platform mounted to the fixed base for partial rotation on the fixed base and a distributing table which is rotatably mounted to the platform. An electrical motor is mounted in the machine and is connected to the rotatable table to rotate the table when the device is in operation. The table carries an ejection device which supports a stack of playing cards and which also is reciprocated below the deck of cards to engage the lowermost card in the deck and slide it from beneath the deck through an ejection slot. As the ejector device continues to reciprocate, it will engage and eject the lowermost card of the deck for each cycle of the ejection mechanism. The ejection mechanism is operated in response to rotation of the table with respect to the platform and reciprocates a plurality of times for each complete revolution of the table, thus ejecting a card from the bottom of the deck a number of times during rotation of the device. The cards are ejected to a plurality of locations circumferentially spaced about the device.

Means also are provided to control the number of cards which are ejected during each ejection movement of the reciprocating ejection device, thus enabling one, two or more cards to be ejected at once.

The operation of the device is begun by initiating rotation of the table (either manually or with a manually operable starting circuit) which causes the platform to rotate partially with respect to the fixed base. The rotation betwen the platform and the fixed base trips a switch which then connects the motor with a suitable electrical power source, such as a battery to thereafter continue automatic operation of the device. After the last card in the deck has been ejected, means are provided for automatically locking the reciprocating ejection device which in turn, causes the motor to begin to rotate the semi-fixed base in a reversed direction which trips the switch and shuts off the power of the motor, thus stopping the device automatically.

The ejection device is designed to engage the lowermost card of the deck smoothly but firmly and without any sharp impulse to the card. After engagement with the card, the ejection device accelerates smoothly to eject the card without damaging it.

It is among the objects of the invention to provide an improved automatic playing card distributing device.

Another object of the invention is to provide an improved card distributing device which distributes the cards smoothly and without damaging them.

A further object of the invention is to provide a card distributing device which may be used with used playing cards and which minimizes the chance of the device becoming jammed.

A further object of the invention is to provide an improved card distributing device in which after the last card has been ejected, the device stops by itself.

Another object of the invention is to provide an improved card distributing device which can eject one or more cards from the bottom of the deck at each card distributing station and at each ejection cycle.

Still another object of the invention is to provide a card distributing device which, once set into operation manually, will continue to distribute cards automatically until the last card has been distributed.

DESCRIPTION OF THE DRAWINGS

The foregoing and other objects and advantages of the invention will be understood more fully from the following further description thereof, with reference to the accompanying drawings wherein:

FIG. 1 is a diagrammatic transverse sectional elevation of the device;

FIG. 2 is a diagrammatic plan illustration of the device;

FIG. 3 is a diagrammatic front elevation of the device as seen from the ejection slot from the left of FIGS. 1 and 2;

FIG. 15 is an illustration of the arrangement shown in FIG. 14 as seen from the line 15—15 of FIG. 14;

FIG. 16 is a sectional elevation of the card ejection end of the device;

FIG. 17 is a front elevation of the card ejection outlet;

FIG. 18 is a cross-sectional elevation of the card pushing end of the ejection device illustrating one manner for controlling the number of cards ejected in each ejection cycle;

DESCRIPTION OF THE PREFERRED EMBODIMENT

Figure 4:
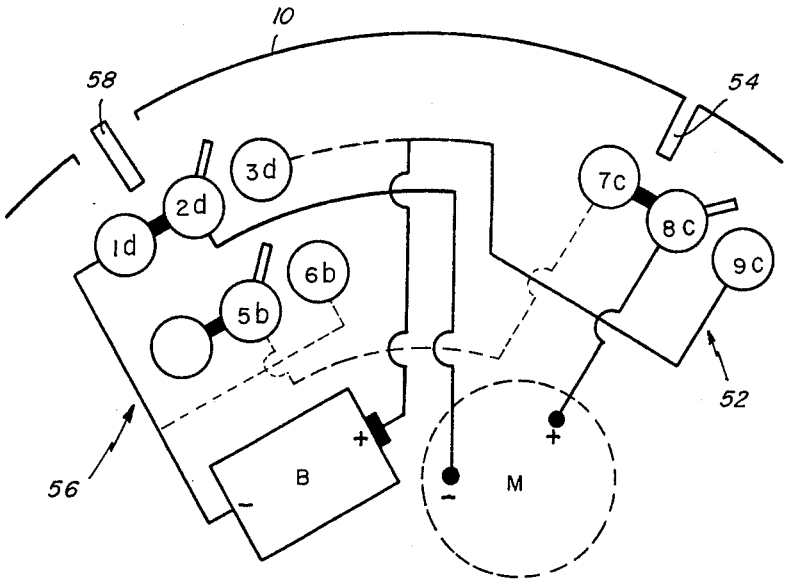
FIG. 4 is a diagrammatic illustration of the electric control of the device in one mode of operation.

FIGS. 1 and 2 show, diagrammatically, the primary parts of the device which include a fixed base 10 and a platform 12 supported on the fixed base 10 for limited rotation thereon. A gear 14 is secured to the platform 12. A table 16 is rotatably mounted to and on top of the platform 12 by the shaft 18. A motor M is mounted in the device and has a drive gear 20 which engages a driven ring gear 22 which is secured to and extends downwardly from the underside of the rotatable table 16. Operation of the motor M causes the table 16 to rotate continuously. The motor may be powered by batteries B mounted in the device. The batteries are connected to the motor through circuitry shown in FIGS. 4 and 5.

The card ejection mechanism is mounted on top of the rotating table 16 for rotation therewith. The mechanism includes a reciprocating member 24 which extends diametrically across the table 16 for rotation with the table as well as reciprocating movement along its length. The reciprocating member 24 has at its forward end a pallet portion 26 which partly supports the deck of cards (suggested in rectangular phantom in FIG. 2). The opposite edge of the deck of cards is supported on a pair of spaced supports 28 which also are mounted to the table for rotation therewith. Thus it will be seen that the cards are supported at three points, two of which are located at the ejection station and the third, on the pallet 26, also serving to provide means by which the cards can be ejected. The member 24 and pallet 26 reciprocate in unison toward and away from the members 28. The reciprocating member 24 includes a card pushing device, such as the ridge-like member 30, which engages the lowermost card in the deck when the member 24 is moved toward an ejection slot. Pushing member 30 engages the card and pushes it through the slot, with the lowermost card sliding over the support members 28.

The member 24 is mounted for reciprocating movement on guides 25 and is reciprocated by a drive linkage which includes a rod 32 pivoted at one end to the member 24. The other end of the rod 32 is pivoted to an end of a crank 34 which in turn is secured to a planet gear 36 which is rotatably mounted to the table 16. Gear 36 meshes with the gear 14 on the platform 23 so that as the table 16 is rotated, gear 36 will be driven about gear 14 thus rotating gear 36 and operating the crank mechanism to reciprocate the member 24. Thus, it will be seen that each time the table 16 makes a complete revolution, gear 36 will make a plurality of complete revolutions, each causing a full reciprocating cycle of the member 24 and causing the lowest card in the deck to be ejected at various angular positions of the table 16. The number of complete revolutions of gear 36 depends on the size of that gear and, by enabling that gear to be interchanged with gears of other sizes, the number of ejection cycles for each complete revolution of the table can be varied which, in turn, determines the number of locations about the device to which cards will be distributed.

FIG. 3 shows the card ejection outlet which is defined at its bottom by the pair of card supports 28 and at the top by the lower edge of a selector bar 38. The height of the selector bar 38 may be varied to vary the space between the bar 38 and the supports 14 and may be adjusted to permit one, two or more cards to pass through the slot each time. The selector plate 38 is supported by a flexible rod 40 which is supported at its ends by table 16. An eccentric cam 42 is pivoted at 44 to the selector plate 38 to engage the flexible rod 40 at its midportion and a pair of forwardly extending fingers 46 project from the support plate 38 to underly and provide support for the flexible rod. The eccentric cam 42 and fingers 46 cooperate to grip the rod 40 thus supporting the support plate 38. The cam 42 may be rotated to a variety of positions which will cause the rod 40 to be bowed as suggested in FIG. 3, the extent of bowing of the rod controlling the height of the selector plate 38 and, therefore, the size of the ejection space. As can be seen more clearly in FIG. 1, the rearwardly facing surface of selector plate 38 engages the forward edge of the deck of cards to preclude the upper cards in the deck from being advanced under the influence of the pusher member 30.

In order to facilitate automatic feeding of the cards in the stack downwardly, a plate 48 may be placed on top of the deck of cards. The plate also may include a device which, when the last card in the deck has been ejected, will bind the ejection mechanism and cause the device to stop, as will be described. To this end, the plate 48 may carry a member 50 which passes through a hole in the plate and which normally rests on top of the uppermost card in the deck. After the uppermost card in the deck has been ejected, the member 50 drops down through the hole in the plate 48 into interfering relation with the pallet 26 to engage the front end of the pallet and block it from advancing further forward. This precludes further rotation of the table 16 by the binding action between gear 36 and gear 14 and, as a result, the operation of motor M causes the platform 12 to rotate with respect to the table 16, but in a reversed direction.

Figure 5:
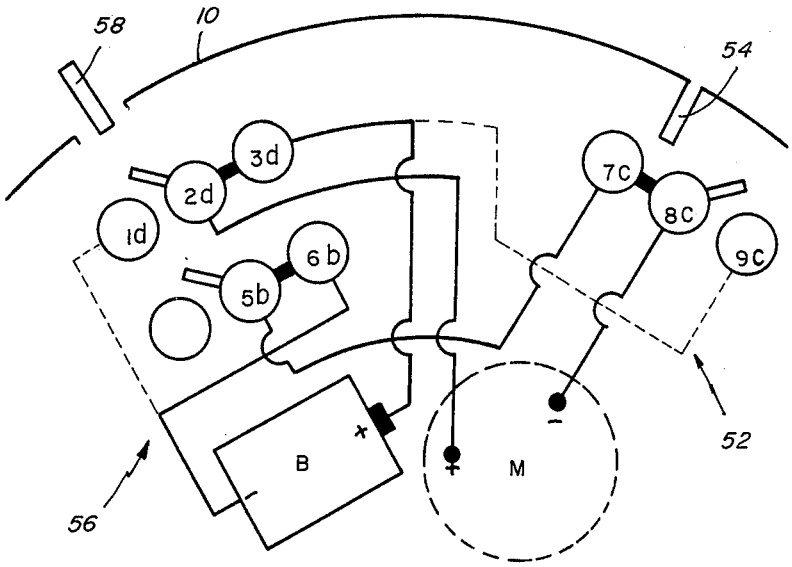
FIG. 5 is a diagrammatic illustration of the electrical control for the device in another mode of operation.

The operation of the device is controlled by a number of switch arrangements shown in FIGS. 1, 4 and 5 which illustrate various modes of operation of the device. In general, when the device is at rest the batteries B and motor M are disconnected. Operation is initiated by loading the device with a deck of cards and then rotating the table manually in the direction in which it is desired to distribute the cards, either clockwise or counterclockwise. The manual rotation of the table 16 also causes platform 12 to rotate with it because of the binding action of gears 36 and 14. Platform 12 carries a switch 52 which, when the platform 12 is rotated, will engage a fixed stop 54 on the fixed base 10 to trip the switch 52 and connect the battery B to the motor M. The motor M is reversible and the switching and circuitry is arranged so that the battery B will be connected to motor M in a polarity which will continue to drive the table 16 the direction in which the table 16 was initially manually rotated. The machine will be automatically driven by the motor M until the last card has been ejected, at which time the member 50 will engage the pallet 26 and bind the ejection mechanism. Once the ejection mechanism has been bound, continued operation of the motor will cause the platform 12 to begin to rotate but in a direction opposite that of the direction in which the table 16 had been rotating previously. This reversed rotation of the platform 12 brings the switch 52 back into engagement with the stop 54 which trips the switch 52 and disconnects the battery B and motor M to stop operation automatically.

In order to control the polarity of the connection between the battery B and motor M, a second, reversing switch 56 also may be carried by the platform 12, the reversing switch having double throws a and b. Reversing switch 56 may be operated by a movable stop 58 mounted to the fixed base 10, the movable stop normally being biased in an out-of-the-way position but being manually movable into a position which will trip both throws a and b of the reversing switch 56. When reversing switch 56 is in the configuration shown in FIG. 4, the polarity of the battery connected to the motor M will be as shown and when the switch 56 is in the configuration shown in FIG. 5, the polarity of the motor M will be reversed as shown in FIG. 5. For example, if it is desired to drive the device counterclockwise as seen in FIG. 4, the movable stop 58 is left alone which connects the negative terminal of battery B to the motor to switch contacts 1a and 2a. The positive of the battery terminals is connected to terminal 9c of switch 52. When the platform 12 is rotated manually and counterclockwise, switch 52 will be tripped to connect terminal 9c to the other motor terminal through contact 8c thus completing the circuit and driving the motor M.

Should it be desired to distribute the cards in a reversed direction, for example, clockwise as seen in FIGS. 4 and 5, reversal switch 56 is switched to the configuration shown in FIG. 5 in which the positive terminal of the battery is connected through terminals 2a and 3a of switch 56 to the motor. As the platform 12 is rotated manually in a clockwise direction, stop 54 will trip switch 52 to the configuration shown in which terminal 7c and 8c are connected. This connects the negative terminal of the battery through contacts 6b, 5b, 7c and 8c to the motor which drives the motor in a reversed direction. When operating in this mode, the device will stop automatically after the last card has been ejected in the same manner as described above.

Figure 6:
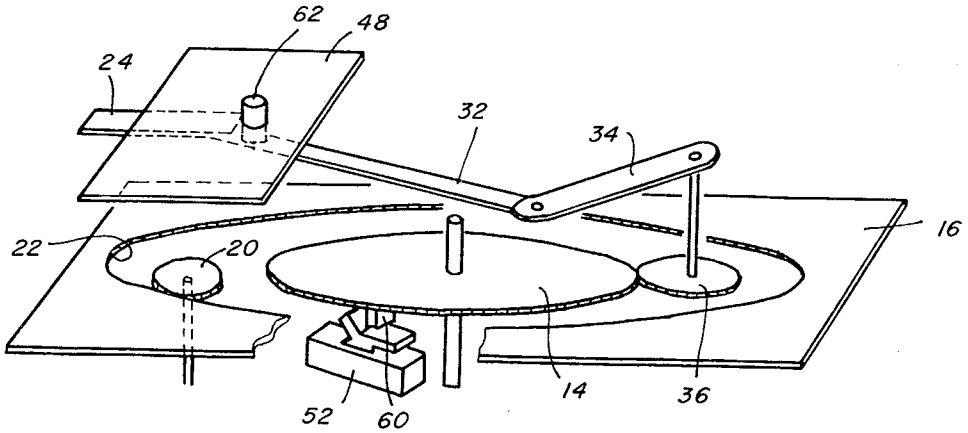
FIG. 6 is a somewhat diagrammatic illustration of a modified embodiment of the machine.

FIG. 6 shows an alternative embodiment of the invention embodying variations in some of the features of the invention described above. For example, in this embodiment switch 52 is mounted to the fixed base 10 and is tripped by a member 60 secured to and extending downwardly from the gear 14 or some other portion of the platform 12. FIG. 6 also shows a variation in the means by which the ejection mechanism may be automatically locked after the last card has been ejected. In this embodiment a peg 62 is receivable through a hole formed in the plate 48. The peg 62 normally rests on the top card in the deck but when that last card is ejected, the peg 62 drops down to rest on the arm 32 of the ejection mechanism. As the motor continues to drive the device and begins to retract the arm 32, the innermost end of the pallet 24 engages the fallen peg 62 thus locking the ejection mechanism which results in automatic stopping of the device in the manner described above.

As mentioned above, one of the advantages in the invention is that the ejection mechanism does not engage the cards in an abrupt or sharp manner but, instead, engages and ejects them smoothly to minimize deterioration and damage to the cards. From the foregoing description it should be understood that when the card-engaging ridge 30 first engages an edge of the card it will do so at a relatively low linear speed because the velocity, in an ejection direction, of the connection between crank 34 and arm 32 is very low. As crank 34 continues to rotate the arm 32 accelerates smoothly to begin to eject the card and then, at the end of its stroke decelerates as the card approaches ejection. This mode of operation also results in the cards being ejected the same distance from the device.

Figure 23:
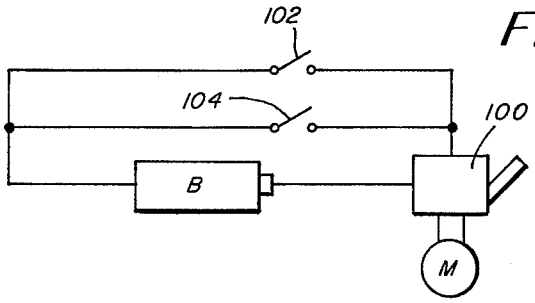
FIG. 23 is a schematic illustration of the electrical circuit of the machine.

FIGS. 7–23 show further possible embodiments and refinements of the invention. In the following description of the modified embodiments, like reference characters to those employed above, distinguishable by a prime mark (′), will be used to designate functionally corresponding elements of the device, where appropriate. As shown in FIGS. 7 and 9–13, this embodiment includes a fixed base 10′. A platform 12′ which is formed from a cam 70 and a gear 14′ secured to the cam 70 is supported on the base 10′ for limited rotation thereon. A table 16′ is rotatably mounted to and on top of the platform 12′, for example, by ball bearings 72 interposed between the gear 14′ and the underside of the table 16′. The table 16′ and platform 12′ are rotatable about a common axis defined by the shaft 74. The table 16′ is rotatably driven about the shaft 74 by a ring gear 22′ which is secured to the underside of the table 16′ and which is engaged by a drive gear 76 which, in turn, is connected to the motor M (FIG. 23). The motor M is disposed within the base 10′. The rotating table 16′ together with the parts carried thereby may be detached from the base 10′ by simple lifting the table 16′. This exposes gears 36′ and 76 which may be mounted to their respective shafts in a manner to permit these gears to be changed, thus controlling the number of ejection cycles of the ejection mechanism and, thereby the number of locations to which the cards are distributed during a complete revolution of the table 16′. The shaft 74 also is preferably mounted to the base 10′ so that it may be easily detached thus enabling all of the operative elements of the machine to be easily disassembled should that be desired.

Figure 7:
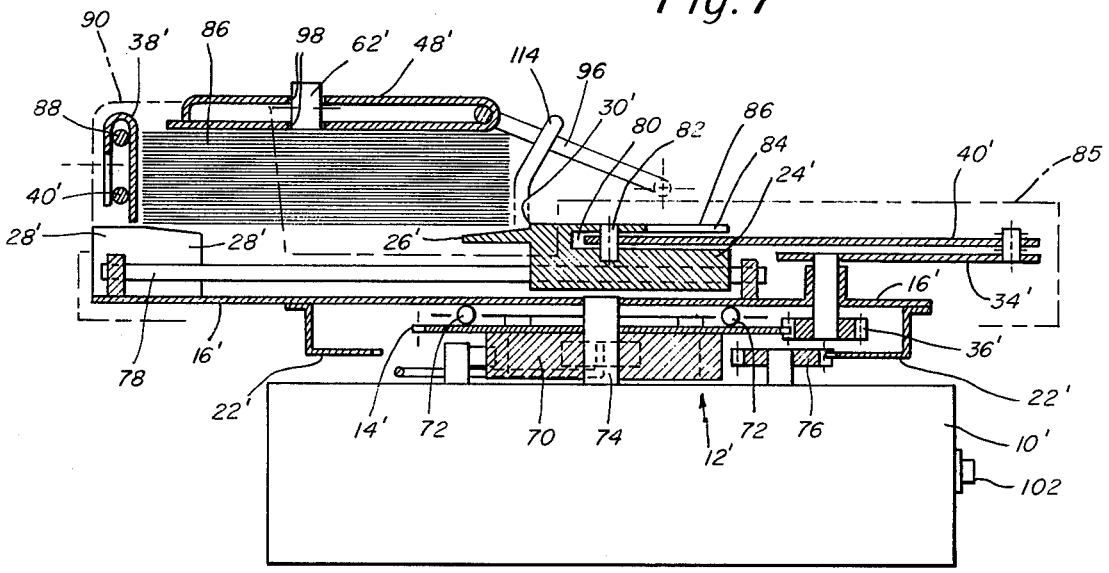
FIG. 7 is a sectional elevation of another embodiment of the invention.
Figure 8:
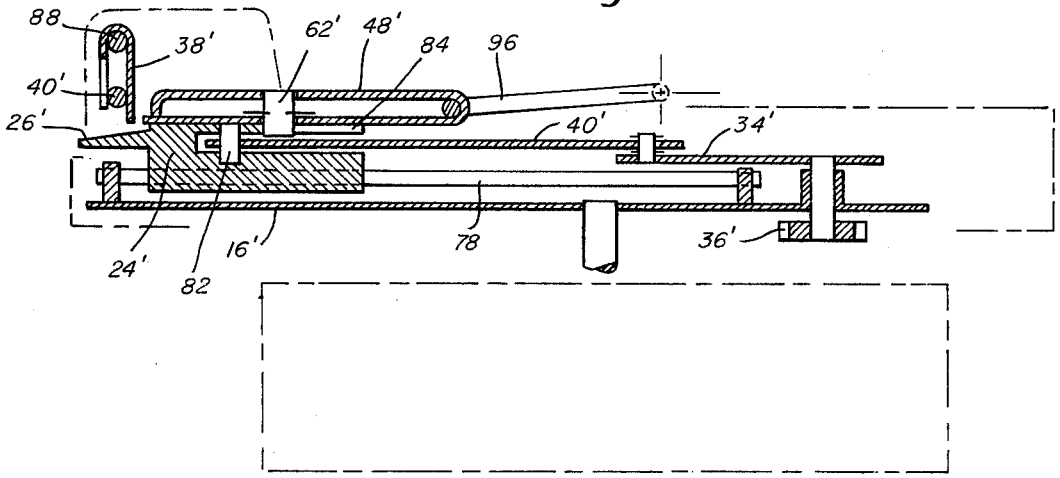
FIG. 8 is a partial illustration of the machine similar to that shown in FIG. 7 illustrating the ejection mechanism in its automatically stopped position.
Figure 10:
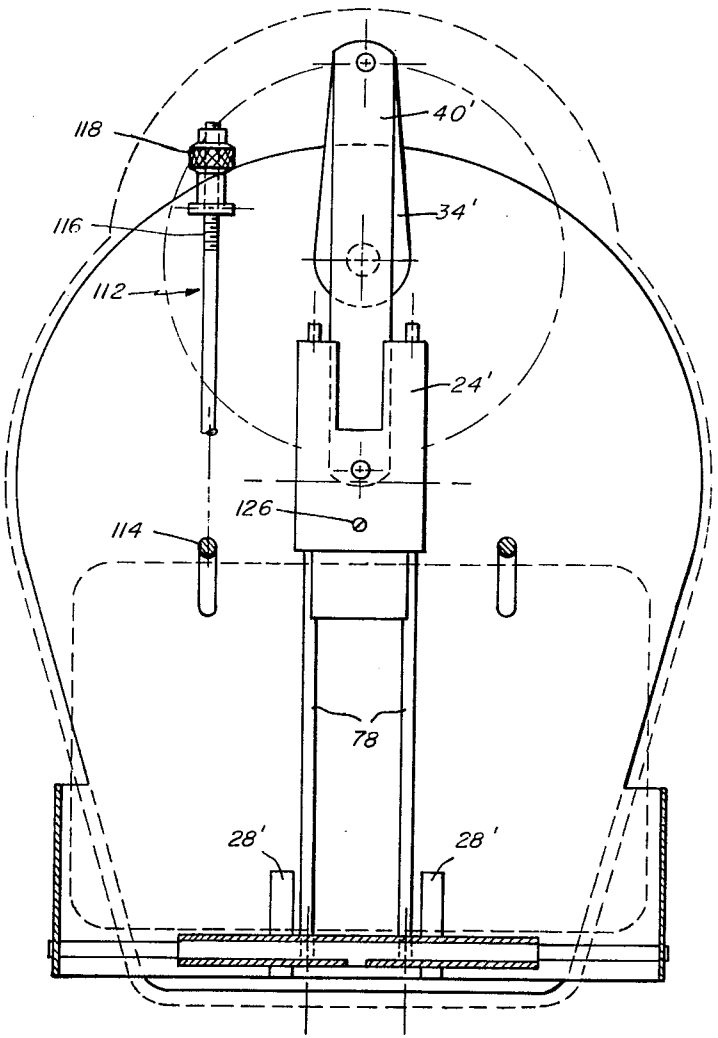
FIG. 10 is a plan view of the embodiment of FIG. 7 illustrating the location and means for supporting the pack of cards with the ejection mechanism in readiness to begin an ejection cycle.
Figure 9:
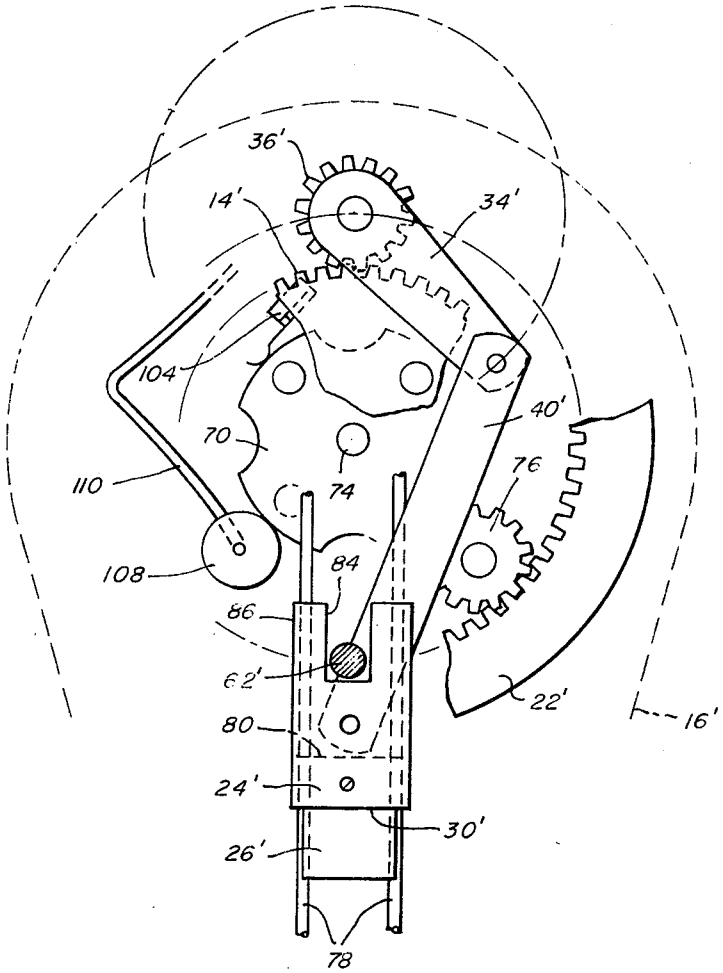
FIG. 9 is a plan illustration of the ejection and drive mechanisms of the embodiment shown in FIG. 7.
Figure 12:
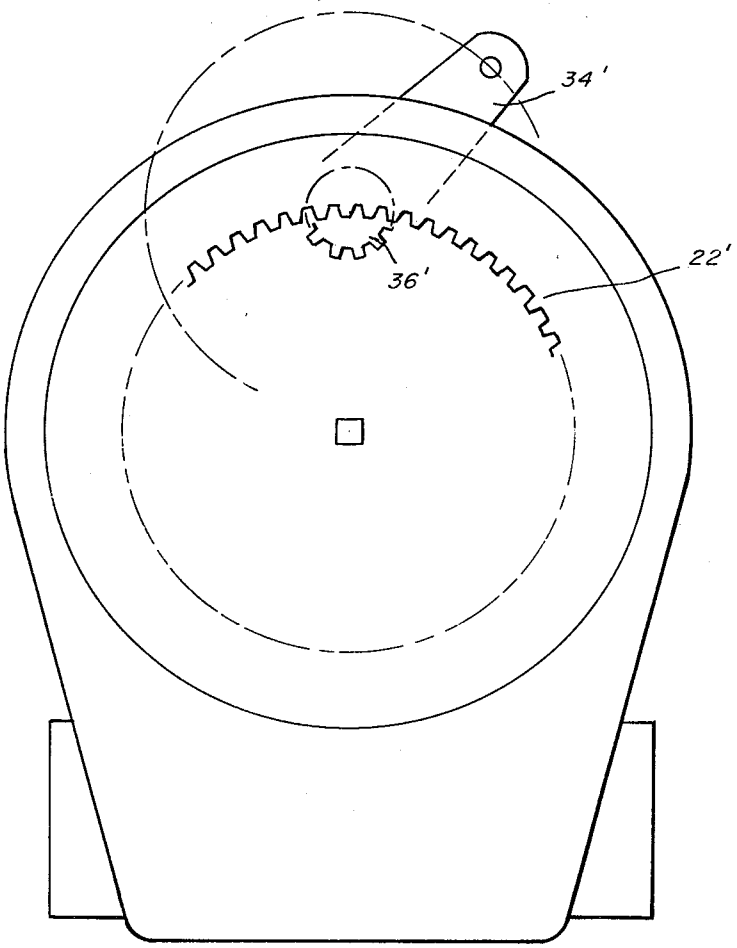
FIG. 12 is a diagrammatic, plan illustration of the lower region of the drive mechanism of the device.
Figure 11:
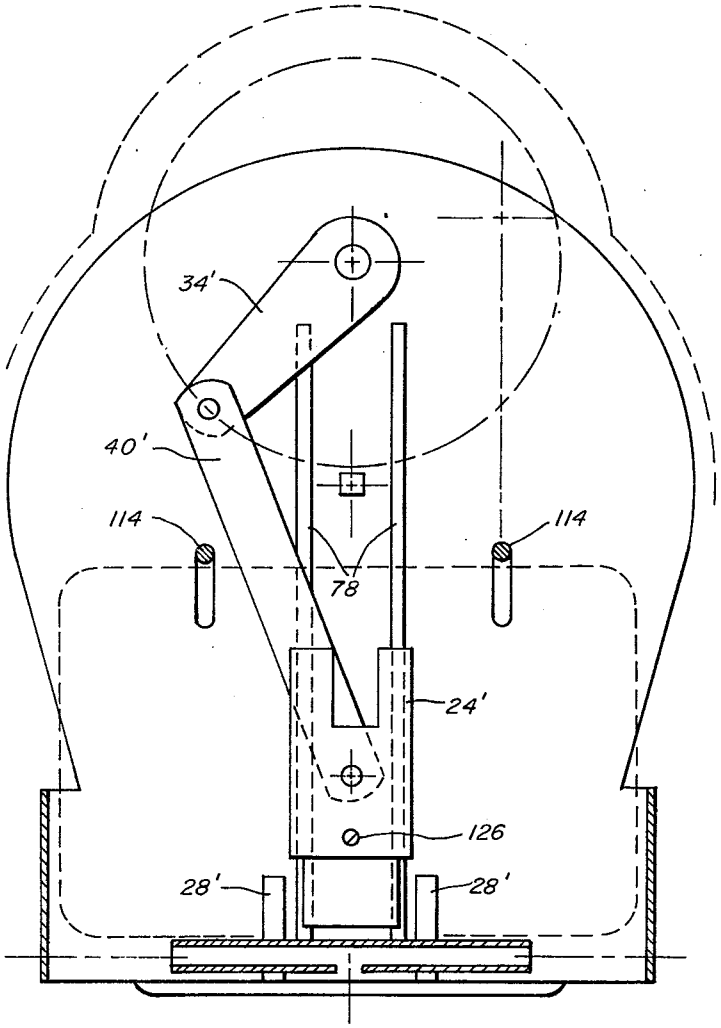
FIG. 11 is an illustration similar to FIG. 10 showing the ejection mechanism nearing the end of its ejection stroke.
Figure 13:
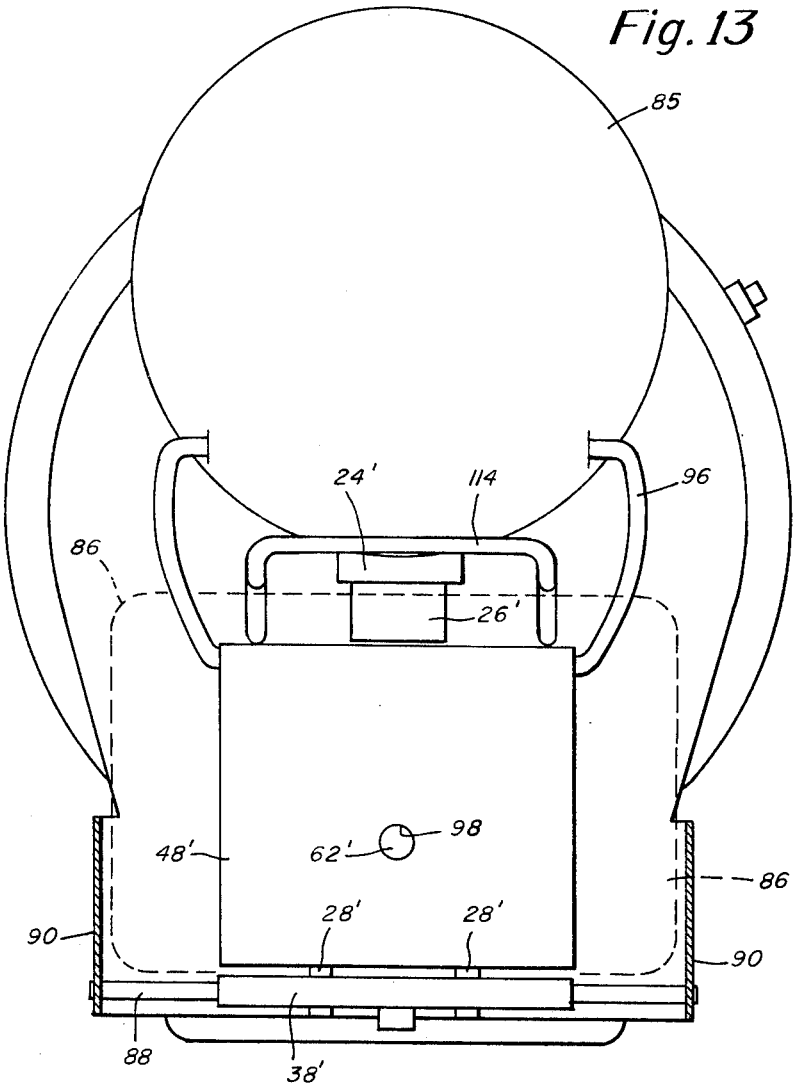
FIG. 13 is a plan view of the device with its covering housing in place.
Figure 14:
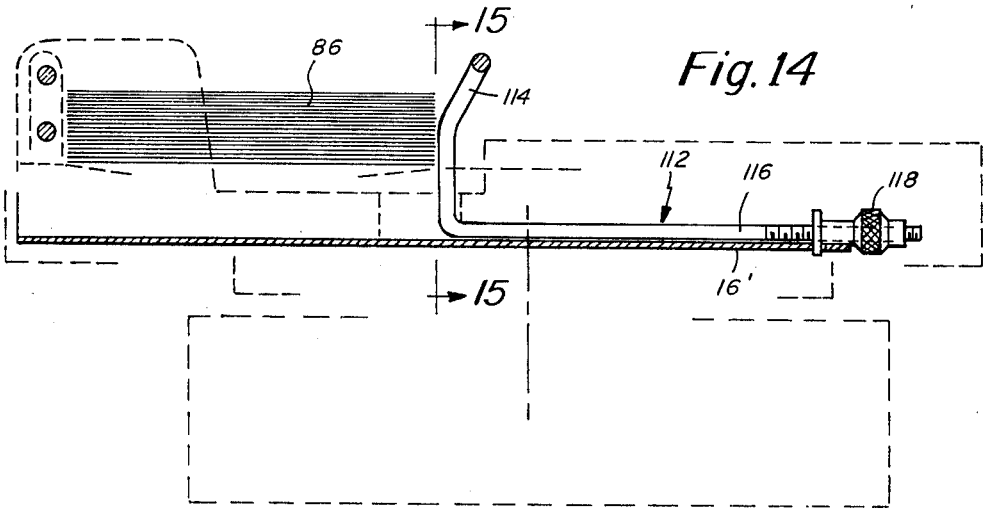
FIG. 14 is a partial elevation further illustrating the manner in which the pack of cards is supported and positioned.
Figure 19:
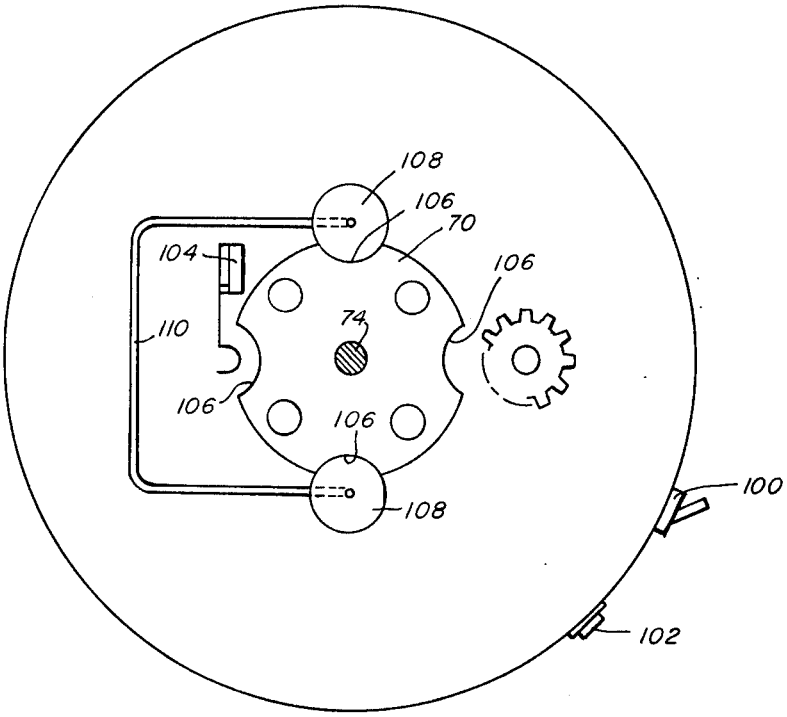
FIG. 19 is an illustration of the cam and switch arrangement for controlling automatic starting and stopping of the device and showing it in an automatic card distributing mode.
Figure 20:
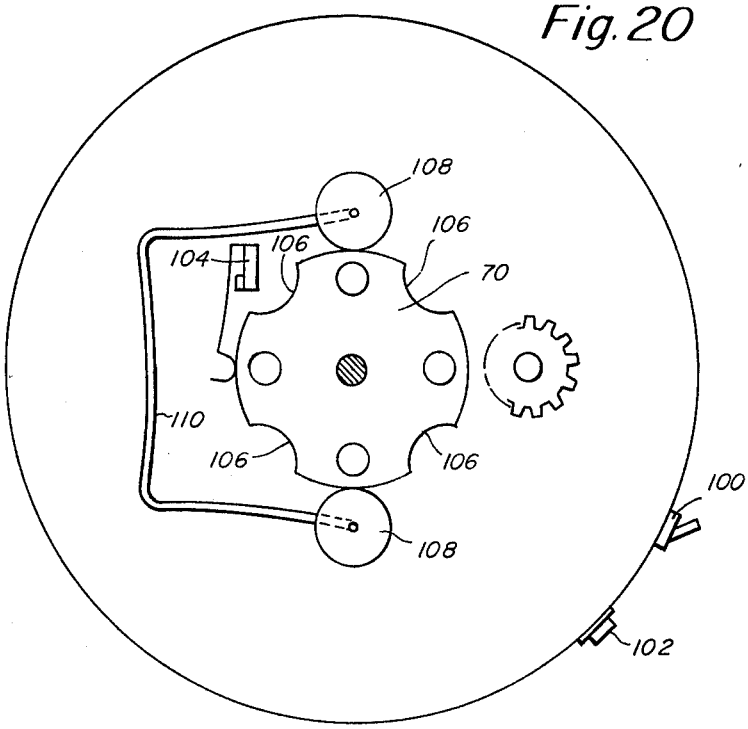
FIG. 20 is an illustration similar to FIG. 19 showing the cam and switch arrangement when the device is stopped.
Figure 21:
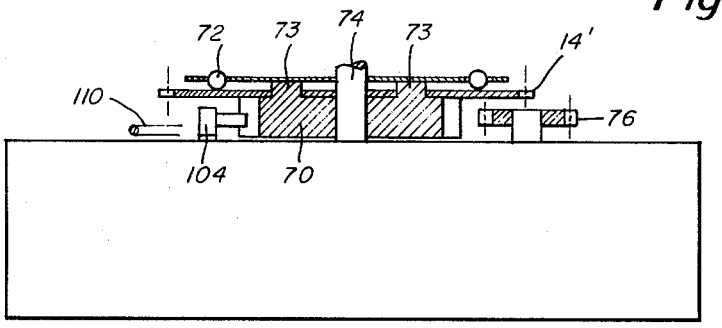
FIG. 21 is a side sectional elevation of the arrangement shown in FIG. 19.
Figure 22:
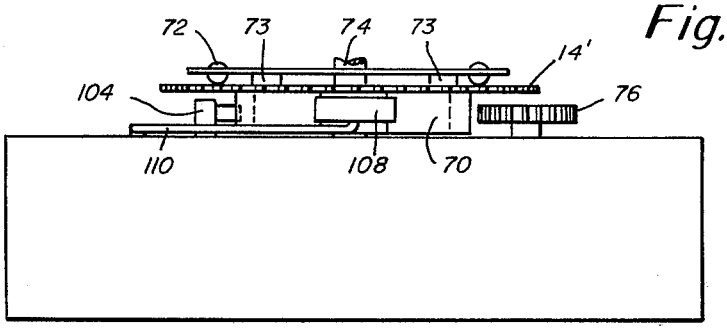
FIG. 22 is a side elevation of the arrangement shown in FIG. 20.

The card ejection mechanism operates in a manner generally similar to that of the previously described embodiment and includes a reciprocating ejection member 24′ which is reciprocated by a connecting rod 40′ which, in turn, is driven by a crank 34′. The crank 34′ is secured to the shaft of planet gear 36′ which is rotatably mounted to the table 16′ and is in mesh with the gear 14′. Rotation of drive gear 76 rotates the table 16′ about the platform 12′ (which is held in a stationary position) to cause the crank arm 34′ to be driven through gear 36′, thus reciprocating the ejector 24′ through the connecting rod 40′. The ejector 24′ is mounted for its reciprocating movement on a pair of spaced, parallel rods 78 mounted to the table and which are received in holes formed longitudinally through the ejector 24′. The crank mechanism is housed in a crank cover 85 (FIGS. 7 and 13).

The ejector 24′ has a forwardly extending pallet portion 26′ at its forward, card-engaging end, the pallet portion having a forwardly and slightly downwardly inclined upper surface which partly supports the cards as will be described. The juncture of the member 24′ and the pallet 26′ defines a ridge or shoulder 30′ which will engage the lowermost card in the deck 86 when the ejector 24′ is advanced forwardly. The ejector 24′ also includes a transverse, rearwardly opening slot 80 through which the foward end of the connecting rod 40′ is received and which enables the connecting rod 40′ to have lateral angular pivotal movement about the pin 82 by which the connecting rod 40′ is attached to the ejector 24′. A rearwardly extending slot 84 is formed along the upper portion 86 of the ejecting member 24′ to aid in stopping the device automatically in the manner suggested in FIG. 6 and as will be further described below.

In this embodiment, as in the previously described embodiments, the pack of cards, indicated at 86 (FIGS. 7 and 10) is supported at three locations, including the support provided at their rear end by the pallet 26′. The pack of cards is supported at its forward end by a pair of spaced supports 28′ located at the ejection of the device. The spaced supports 28′ may have upper edges which incline slightly downwardly and rearwardly as illustrated in FIG. 7. The inclined card-supporting surfaces of the supports 28′ and the pallet 26′ insure that the card-engaging shoulder 30′ will engage the edge of the card, even if the card is bent.

The ejection station includes an ejection slot which functions in a manner similar to that previously described and includes means for defining a transversely extending card ejection slot through which the ejected card or cards pass. The height of the ejection slot is variable to control the number of cards ejected in each cycle. As shown more fully in FIGS. 16 and 17, the card ejection outlet configuration in this embodiment is defined at its bottom by the pair of card supports 28′ and at the top by the lower edge of a selector bar 38′. Generally, the upper limit of the ejection slot may be defined by a pair of spaced projections 39′ which extend downwardly from the selector bar 38′ and are disposed over the card supports 28′. The selector bar 38′ is of U-shaped configuration and is supported by a flexible rod 40′ which, in turn, is supported at its ends by upwardly extending portions 90 of the table 16′. The rod 40′ extends transversely through the U-shaped region of the selector plate 38′. The selector 38′ is maintained in a vertical attitude by means of a transversely extending rod 88, also secured at its ends to the portions 90 of the table 16′ and received through the bight region of the selector plate 38′. Selector plate 38′ is held in position by a nut 92 the midportion of the selector plate 38′ and within its U-shaped region and a pair of laterally spaced fingers 46′ also mounted to the selector bar to underlie and engage the flexible rod 40′ on opposite sides of the nut 92. The nut 92 is eccentrically mounted and is used to control the height of the plate 38′. The nut 92 can be rotated to a number of positions, each of which will vary the extent to which the rod 40′ is bowed, thus varying the height of the selector plate 38′ and the height of the opening at the ejection station. The eccentric nut 92 may be rotated by a forwardly extending slotted portion 94 which extends forwardly and is exposed through the front face of the selector plate 38′. As with the previous embodiment, the rearwardly facing surface of the selector plate 38′ engages the forward edge of the deck of cards to preclude the upper cards in the deck from being advanced under the influence of the card pushing member 30′.

In order to facilitate feeding of the cards, a pressure plate 48′ is placed on top of the card deck as shown in FIGS. 7 and 13. The pressure plate 48′ is attached to the crank housing 85 by a bracket 96 which is pivotally connected to each of the crank housing 85 and the pressure plate 48′. The pressure plate 48′ also includes means by which the device may be stopped automatically after the last (the uppermost) card in the deck has been ejected. To this end, a hole 98 is formed through the plate 48′ and receives a peg 62′ which, when the device is loaded, rests on top of the uppermost card in the pack. As the last card is ejected (FIG. 8) and the ejector 24′ is in its forwardmost position, the peg 62′ drops down into the slot 84 of the ejector 24′ and becomes caught in the forward end of the slot 84 as the ejector 24′ begins to retract. This binds the ejecting mechanism and results in automatic stopping of the device in the manner described below.

The operation of this embodiment, including the starting and automatic stopping is controlled by the cam 70 in cooperation with the electrical power circuits shown in FIGS. 19 through 23. FIG. 23 shows the electrical circuit which includes suitable source of power, such as the battery B and a reversable motor M. The polarity of the current supplied to the motor is controlled by a reversing switch 100 which can be set to drive the motor either clockwise or counterclockwise, thus controlling the direction of card distribution. Interposed between the battery B and reversing switch 100 is a manually operated starting switch 102 which is used only to begin operation of the device. A second, running switch 104 also is connected between the battery B and reversing switch 100 and in parallel with the starting switch 102. The running switch 104 is operated by the cam 70, the cam 70 being rotated into position in response to manual initiation of the motor through operation of starting switch 102. As shown in FIGS. 19–22, the cam 70 is rotatable about the axis defined by the shaft 74 and is generally circular except that it is provided with four equiangularly shaped depressions 106. The cam 70 is embraced at diametrically opposed locations by a pair of cylindrical rollers 108 which are rotatably mounted to the ends of a U-shaped spring 110. The spring 110 is mounted to the base 10′ and is arranged so that the rollers 108 will be biased inwardly against the peripheral contour of the cam 70. When in the stopped position shown in FIGS. 20 and 22, the rollers 108 are engaged with the circular periphery of the cam lobes and present little resistence to rotation of the cam 70. Running switch 104 is also mounted to the fixed base 10 so that when the cam 70 is in the stopped position shown in FIG. 19, the trippable portion of the switch 104 will be engaged with a lobe to maintain the switch 104 in an open position.

When starting the device, the reversing switch 100 is set to correspond to the intended direction of rotation and starting switch 102 is manually actuated. The mass of the deck of cards together with the rotatable table 16' and other elements carried thereby presents sufficient resistence to turning in response to initial actuation of the motor M so that the torque generated by the motor will be transmitted through gear 76, gear 22' and gear 36' to the gear 14' which will rotate the cam 70. At this time, the engagement of the rollers 108 with the circular periphery of the cam lobes presents little resistance to rotation of the cam 70. As the cam 70 rotates to the position shown in FIGS. 19 and 21, the rollers 108 engage the depressions 106 to provide significant resistance to further rotation of the cam. When in the position shown in FIG. 19, the actuable element of running switch 104 is disposed opposite one of the unengaged depressions to permit the switch 104 to return to its normally closed configuration to close the circuit between the battery and motor. The manual starting switch 102 then may be released. With the cam 70 being engaged by the rollers 108, the torque of the motor M will be applied through gear 76 and 22' to the table 16' to rotate the table and distribute the cards in the manner described.

After the last card has been distributed and the peg 62' has engaged the ejection member 24' to bind the ejection mechanism to preclude further rotation of the table, the torque of the motor is applied to the cam 70 through gears 14', 36', and 22'. This is sufficient to overcome the resistance of the spring biased rollers 108 and enables the cam 70 to begin to rotate toward the position shown in FIGS. 20 and 22. When one of the lobes engages the running switch 104, that switch is opened to break the circuit between the battery and the motor and the device stops automatically with the cam 70 in the position suggested in FIGS. 20 and 22.

The foregoing control and drive arrangement is effective not only to start and stop the device when desired, but is also effective to automatically shut off the machine in the event that it becomes jammed, although it is to be noted that the chances of the machine becoming jammed are remote. Also, it should be noted that while the manual starting switch 102 is a desirable feature of the invention, it could be omitted and the initiation of the table rotation could be effected by manually binding the ejection mechanism and simultaneously manually rotating the table.

The device also may include an arrangement to facilitate proper placement of the pack of cards. As shown in FIGS. 10, 11, 13, 14 and 15, the device may include a guide 112 formed from a wire having a forward U-shaped, upwardly extending portion 114 which engages the rearward edge of the pack of cards. The wire includes rearwardly extending portions 116 which can slide in a forward-rearward direction on the table. The forward-rearward position of the wire 112 can be adjusted by means of a nut 118 which is threaded onto one of the rearward ends of the wire 112 and which is rotatably attached to the table 16'. The upwardly extending portion 112 also precludes the pack from being drawn rearwardly by the ejector 24'.

FIG. 18 shows an alternative device for controlling the number of cards ejected in each ejection cycle. In this arrangement, the ejection member 24' includes a plate 120 which has a forward end 122 disposed just behind the pallet portion 26' and which the forward edge 122 of the plate serves as the card-engaging, pushing member. The elevation of the forward edge of the plate may be varied so that it will engage one or more cards as desired. To this end, a screw 124 is threaded into the top of the ejection member 24' and the plate rests on top of the screw 124. A small hole 126 is formed through the plate 120 and in registry with the screw 124 to enable the height of the screw and, therefore, the elevation of the plate to be adjusted. This manner of controlling the number of cards ejected may be used independently of the ejection slot control bar 38' or in combination therewith, as desired.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A device for distributing playing cards comprising:
a fixed base;
a table rotatably mounted on the base;
drive means for rotating the table, said drive means being normally inoperative to drive said table;
means responsive to partial preliminary rotation of the table for switching the drive means into an operative condition to drive the table;
means for supporting a deck of cards on the table for rotation therewith;
ejection means carried by the table and operative in response to rotation of the table, said ejection means being constructed and arranged to engage the bottom card in the deck and eject the bottom card for each operation of the ejection means, the ejection means being constructed and arranged as to effect a predetermined number of complete cycles thereof for each complete rotation of the table; and
means responsive to ejection of the last card in the deck for disabling the drive means thereby automatically stopping the device.

2. A device as defined in claim 1 wherein said drive means comprises an electric motor and wherein the motor is connected to a power source therefor by switch means responsive to said preliminary rotation for connecting the motor and the power source.

3. A device as defined in claim 2 further comprising:
manually operable switch means for temporarily connecting the electric motor in the power source to effect said partial preliminary rotation of the table.

4. A device as defined in claim 2 wherein said switch means further includes means for reversing the polarity of the power source applied to the motor, said motor being reversible whereby the direction of rotation of said table may be reversed.

5. A device as defined in claim 2 further comprising:
manually operable reversing switch means connected between the power source and the motor, said motor being reversable whereby the directions of rotation of said table may be reversed.

6. A device as defined in claim 1 further comprising:
an ejection outlet mounted to the table;
said deck of cards being supported on the table by at least three supports, two of said supports being disposed in spaced relation at the ejection outlet, the third of said supports comprising a pallet mounted to the table rearwardly of and between the first two supports.

7. A device for distributing play cards comprising:

a fixed base;
a table rotatably mounted on the base;
drive means for rotating the table;
means for supporting a deck of cards on the table for rotation therewith;
ejection means carried by the table and operative in response to rotation of the table, said ejection means being constructed and arranged to engage the bottom card in the deck and eject the bottom card for each operation of the ejection means, the ejection means being constructed and arranged as to effect a predetermined number of complete cycles thereof for each complete rotation of the table;
means responsive to ejection of the last card in the deck for disabling the drive means thereby automatically stopping the device;
an ejection outlet mounted to the table;
said deck of cards being supported on the table by at least three supports, two of said supports being disposed in spaced relation at the ejection outlet, the third of said supports comprising a pallet mounted to the table rearwardly of and between the first two supports;
each of said three supports each having an upper card-supporting surface, the card-supporting surfaces of said two of said supports being inclined downwardly and rearwardly and said card-supporting surface of said pallet being inclined downwardly and forwardly.

8. A device as defined in claim 7 wherein the ejection means comprises:
said pallet being reciprocally movable toward and away from the ejection outlet, the pallet having a card-engaging member extending upwardly therefrom to an extent sufficient to engage at least the lowermost card in the deck and to slide said engaged cards through the ejection outlet in response to forward movement of the pallet.

9. A device as defined in claim 8 further comprising:
means for adjusting the extent to which said card-engaging member extends upwardly from the pallet thereby to adjust the number of cards engaged by the card-engaging member.

10. A device as defined in claim 1 where said ejection mechanism further comprises:
a pallet being mounted for linear reciprocating movement on the table;
a crank arm pivotally connected to the opposite end of the pallet;
a planet gear rotatably mounted to the table;
the other end of the crank arm being connected to the planet gear; and
a fixed gear mounted in the device in mesh with the planet gear, the fixed gear remaining stationary relative to the table during operation of the device whereby said table rotates, the planet gear will rotate thereby driving the crank arm and causing said reciprocating motion of the pallet.

11. A device as defined in claim 10 further comprising:
means enabling the planet gear to be interchanged with other planet gears thereby to vary the gear ratio between the planet gear and the fixed gear.

12. A device for distributing playing cards comprising:
a fixed base;
a table rotatably mounted on the base;
drive means for rotating the table;
means for supporting a deck of cards on the table for rotation therewith;
ejection means carried by the table and operative in response to rotation of the table, said ejection means being constructed and arranged to engage the bottom card in the deck and eject the bottom card for each operation of the ejection means, the ejection means being constructed and arranged as to effect a predetermined number of complete cycles thereof for each complete rotation of the table;
means responsive to ejection of the last card in the deck for disabling the drive means thereby automatically stopping the device;
a pressure plate constructed and arranged to be placed on top of the uppermost card in the deck;
detent means carried by the pressure plate and extending through a hole in the pressure plate to rest on the uppermost card in the deck, said detent means being disposed such that as the uppermost card in the deck is ejected from the device the detent means will fall and project through the hole, the detent means being located so as to interfere with the ejection mechanism and lock the ejection mechanism from further operation; and
the drive means being constructed and arranged to become disabled in response to locking of the ejection mechanism.

13. A device as defined in claim 12 further comprising:
said detent means and ejection mechanism being constructed and arranged to engage the detent means immediately after the ejection mechanism has completed its forward, ejection stroke.

14. A device as defined in claim 1 further comprising:
the ejection means having an ejection outlet including an ejection slot dimensioned to pass at least one card therethrough;
means enabling the height of the ejection slot to be varied to enable the selected number of cards to be ejected therethrough at the same time.

15. A device as defined in claim 14 wherein the ejection station further comprises:
means for supporting the deck of cards on the table at at least three locations, two of said locations being disposed at the ejection outlet and being spaced with respect to each other, the third of said supports comprising a pallet mounted to the table rearwardly of the first two supports;
a selector bar disposed above said two spaced supports; and
means for varying the height of the selector bar above said two supports.

16. A device for distributing playing cards comprising:
a fixed base;
a table rotatably mounted on the base;
drive means for rotating the table;
means for supporting a deck of cards on the table for rotation therewith;
ejection means carried by the table and operative in response to rotation of the table, said ejection means being constructed and arranged to engage the bottom card in the deck and eject the bottom card for each operation of the ejection means, the ejection means being constructed and arranged as to effect a predetermined number of complete cycles thereof for each complete rotation of the table;

means responsive to ejection of the last card in the deck for disabling the drive means thereby automatically stopping the device;

the ejection means having an ejection outlet including an ejection slot dimensioned to pass at least one card therethrough;

means enabling the height of the ejection slot to be varied to enable a selected number of cards to be ejected therethrough at the same time;

said ejection station further comprising means for supporting the deck of cards on the table at at least three locations, two of said locations being disposed at the ejection outlet and being spaced with respect to each other, the third of said supports comprising a pallet mounted to the table rearwardly of the first two supports; a selector bar disposed above said two spaced supports; and means for varying the height of the selector bar above said two supports, said variable heightwise positioning means comprising:

a flexible rod supported at its ends by the table and over said two supports;

the selector bar having a pair of spaced projections extending forwardly therefrom;

eccentric cam means mounted to the selector bar for rotation thereon about the two projections, the cam and two supports being disposed with respect to the flexible rod to grip the rod therebetween and to cause the rod to bow to an extent determined by the position of the eccentric cam means, the extent of bowing of the flexible rod determining the heightwise positioning of the selector plate.

17. A device for distributing playing cards comprising:

a base;

a platform rotatably mounted to the base;

a first gear rigidly secured to the platform;

a table rotatably supported by the platform;

a ring gear secured to the table;

a motor having a drive gear attached thereto, the drive gear being in mesh with the ring gear;

means mounted to the table for supporting a deck of cards;

an ejector mounted to the table, the ejector being reciprocable to sequentially eject cards from the deck in the direction away from the device; and means for reciprocating the ejector device including a crank mechanism mounted to the table for rotation therewith, the crank mechanism connected to the ejector, the crank mechanism further including a second gear in mesh with said first gear, said second gear being rotated in response to rotation of said table with respect to said platform.

18. A device as defined in claim 17 further comprising:

said table, ring gear, means for supporting the deck of cards, ejector and means for reciprocating the ejector being detachable, as a unit, from the remaining elements of the device.

19. A device for distributing playing cards comprising:

a base;

a platform rotatably mounted on the base;

a table rotatably mounted on the platform;

electrically powered drive means for rotating the table with respect to the base and the platform;

means for supporting a deck of cards on the table for rotation therewith;

ejection means carried by the table and being in engagement with the platform, said ejection means being operative in response to rotation of the table with respect to the platform to eject cards from the deck to a plurality of circumferentially spaced locations about the device;

means responsive to ejection of the last card of the deck for precluding further operation of the ejection means;

said platform including a cam;

means for normally precluding rotation of the cam during operation of the ejection means;

means responsive to stopping of the ejection means for rotating the cam; and switch means responsive to rotation of the cam for terminating operation of the drive means.

* * * * *